US008567147B1

(12) United States Patent
Verhoef

(10) Patent No.: US 8,567,147 B1
(45) Date of Patent: Oct. 29, 2013

(54) ROOF SHINGLE ASSEMBLY

(76) Inventor: Ryan J. Verhoef, Belton, TX (US)

( * ) Notice: Subject to any disclaimer, the term of this patent is extended or adjusted under 35 U.S.C. 154(b) by 477 days.

(21) Appl. No.: 12/895,309

(22) Filed: Sep. 30, 2010

(51) Int. Cl.
*E04D 5/02* (2006.01)
*E04D 5/06* (2006.01)
*E04D 5/10* (2006.01)

(52) U.S. Cl.
USPC ..... 52/518; 52/553; 52/535; 52/560

(58) Field of Classification Search
USPC ..... 52/533, 554, 555, 559, 560, 558, 518, 52/535, 553
See application file for complete search history.

(56) References Cited

U.S. PATENT DOCUMENTS

| | | | | | |
|---|---|---|---|---|---|
| 1,241,146 | A | * | 9/1917 | Perry | 156/71 |
| 1,800,403 | A | * | 4/1931 | Barnhart et al. | 52/535 |
| 2,093,559 | A | * | 9/1937 | Hobbie | 52/533 |
| 2,103,076 | A | * | 12/1937 | Harshberger et al. | 52/519 |
| 2,636,226 | A | * | 4/1953 | Holland | 52/553 |
| RE24,246 | E | * | 12/1956 | Fink et al. | 52/543 |
| 3,417,531 | A | * | 12/1968 | Jones | 52/520 |
| 4,081,939 | A | * | 4/1978 | Culpepper et al. | 52/535 |
| D277,411 | S | | 1/1985 | Spinelli et al. | |
| 4,499,701 | A | * | 2/1985 | Bockwinkel et al. | 52/555 |
| 5,813,184 | A | | 9/1998 | McKenna | |
| 6,194,519 | B1 | | 2/2001 | Blalock et al. | |
| 6,272,807 | B1 | * | 8/2001 | Waldrop | 52/518 |
| 6,495,635 | B1 | | 12/2002 | Edson | |
| 6,519,905 | B1 | * | 2/2003 | Knighton | 52/378 |
| 6,983,571 | B2 | * | 1/2006 | Felton | 52/309.13 |
| 7,442,658 | B2 | | 10/2008 | Rodrigues et al. | |
| 2004/0172910 | A1 | * | 9/2004 | Gilbert et al. | 52/555 |
| 2008/0083184 | A1 | | 4/2008 | Smith | |

* cited by examiner

*Primary Examiner* — Phi A

(57) ABSTRACT

A roof shingle assembly includes a panel that has a front edge, a rear edge, a first side edge and a second side edge. The panel has a first bend and a second bend therein each extending between the first and second side edges. The first and second bends defining a first section positioned between the first bend and the rear edge, a second section positioned between the second bend and the front edge and an intermediate section positioned between the first and second bends. The first and second sections extends away from the intermediate section in opposite directions with respect to each other. The first and second sections lie in planes orientated parallel to each other and vertically spaced from each other. The plane of the first section is positioned below a plane of the second section.

6 Claims, 3 Drawing Sheets

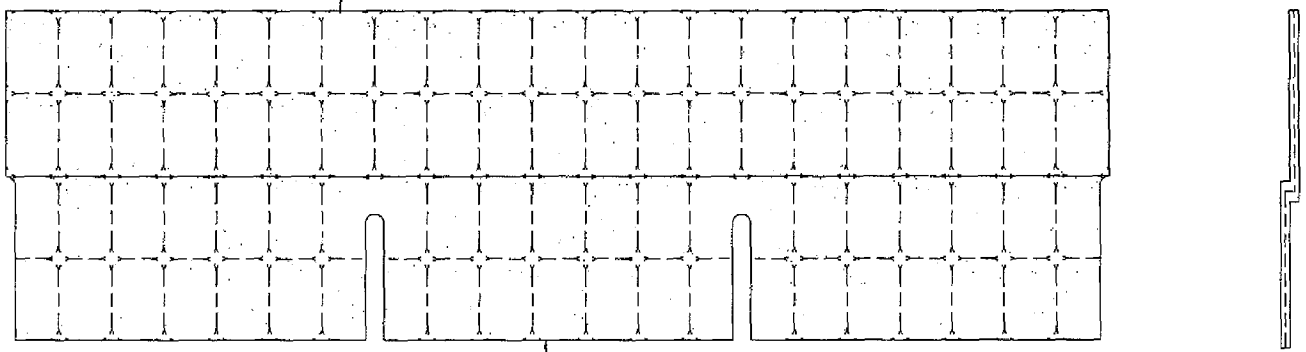
FIG. 2
FIG. 3
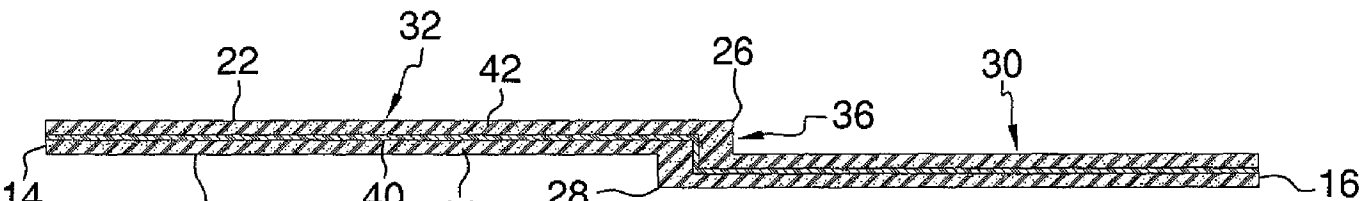
FIG. 4

ROOF SHINGLE ASSEMBLY

BACKGROUND OF THE DISCLOSURE

Field of the Disclosure

The disclosure relates to roof shingles and more particularly pertains to a new roof shingle for providing a more efficient and effective installation process for shingling a roof.

SUMMARY OF THE DISCLOSURE

An embodiment of the disclosure meets the needs presented above by generally comprising a panel that has a front edge, a rear edge, a first side edge, a second side edge, a top side and a bottom side. The panel has a first bend therein extending between the first and second side edges and is spaced from the front and rear edges. The panel has a second bend therein positioned adjacent to the first bend and extending between the first and second side edges. The first and second bends defining a first section positioned between the first bend and the rear edge, a second section positioned between the second bend and the front edge and an intermediate section positioned between the first and second bends. The first and second sections extends away from the intermediate section in opposite directions with respect to each other. The first and second sections lie in planes orientated parallel to each other and vertically spaced from each other. The plane of the first section is positioned below a plane of the second section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 2 is a top view of an embodiment of the disclosure.

FIG. 3 is a side view of an embodiment of the disclosure.

FIG. 4 is a cross-sectional view of an embodiment of the disclosure taken along line 4-4 of FIG. 2.

DESCRIPTION OF THE PREFERRED EMBODIMENT

Figure 1:
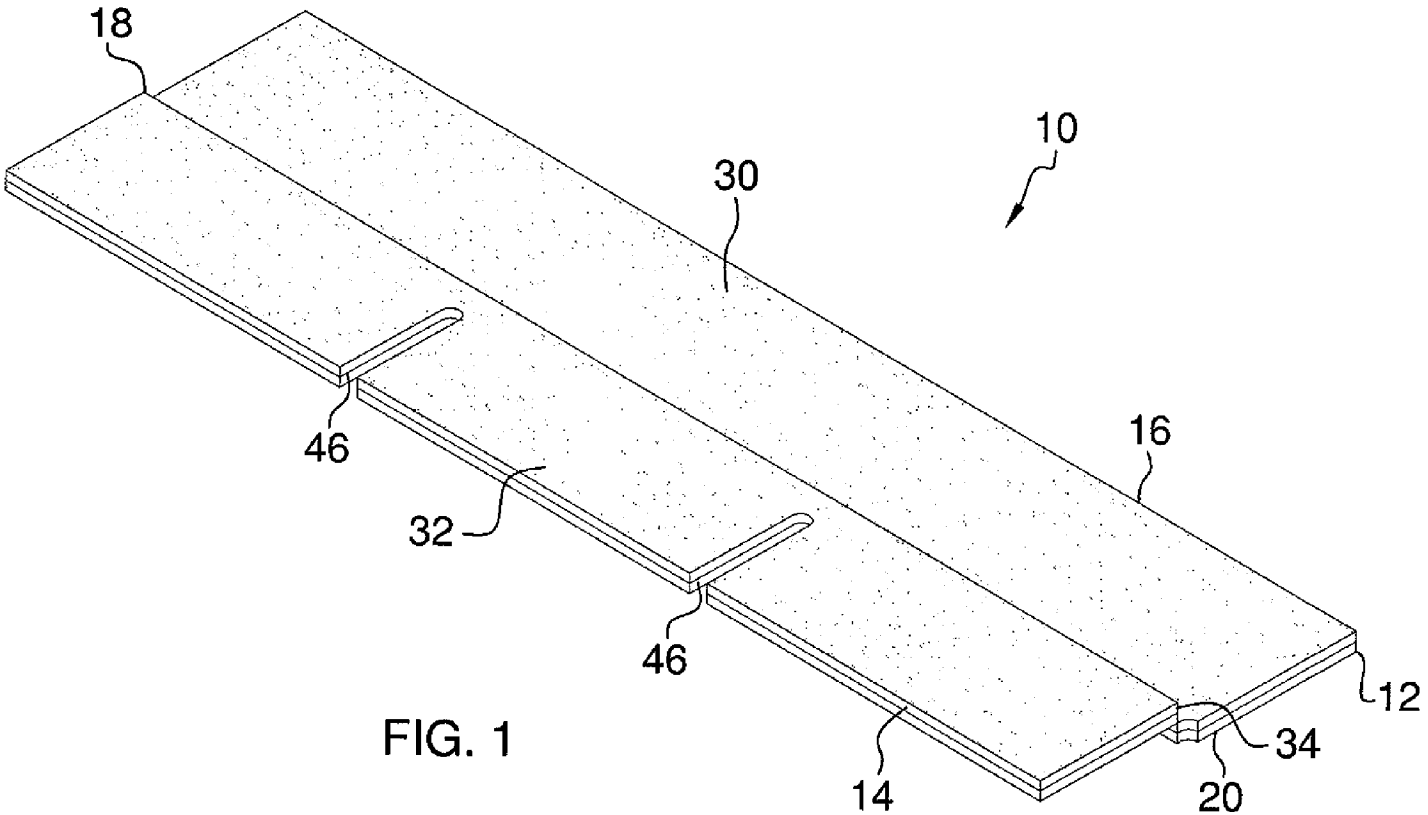
FIG. 1 is a top perspective view of a roof shingle assembly according to an embodiment of the disclosure.
Figure 5:
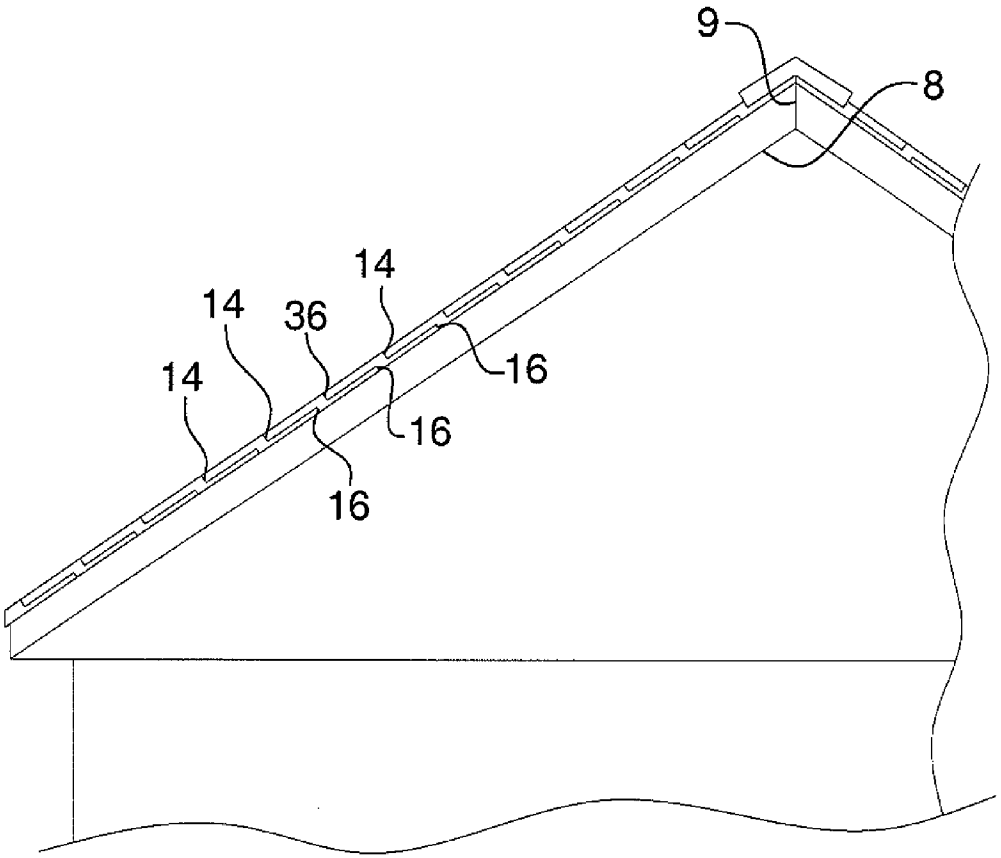
FIG. 5 is a side in-use view of an embodiment of the disclosure.

With reference now to the drawings, and in particular to FIGS. 1 through 5 thereof, a new roof shingle embodying the principles and concepts of an embodiment of the disclosure and generally designated by the reference numeral 10 will be described.

As best illustrated in FIGS. 1 through 5, the roof shingle assembly 10 generally comprises a panel 12 that has a front edge 14, a rear edge 16, a first side edge 18, a second side edge 20, a top side 22 and a bottom side 24. The panel 12 has a first bend 26 therein extending between the first 18 and second 20 side edges and is spaced from the front 14 and rear 16 edges. The panel 12 has a second bend 28 therein positioned adjacent to the first bend 26 and extending between the first 18 and second 20 side edges. The first 26 and second 28 bends define a first section 30 positioned between the first bend 26 and the rear edge 16, a second section 32 positioned between the second bend 26 and the front edge 14 and an intermediate section 36 positioned between the first 26 and second 28 bends. The first 30 and second 32 sections extend away from the intermediate section 36 in opposite directions with respect to each other.

The first 30 and second 32 sections lie in planes orientated parallel to each other and vertically spaced from each other. In particular, the plane of the first section 30 is positioned below a plane of the second section 32.

A first distance measured along the bottom side 24 of the second section 32 from the front edge 14 to the intermediate section 36 is equal to or less than a second distance measured along the top side 22 of the first section 30 from the intermediate section 36 to the rear edge 16. This allows the assembly 10, when stacked on other assemblies, to position the first section 30 below the second section 32. The first section 30 may have a length so that its rear edge 16 can abut the intermediate section 36 of another shingle assembly 10 while its intermediate section 36 abuts the front edge 14 of the other shingle assembly 10.

A height dimension of the intermediate section 36 measured from the bottom side 24 of the first section 30 to the bottom side 24 of the second section 32 is equal to or less than a height of the panel 12 measured from the bottom side 24 to the top side 22. This will prevent bulging and lifting from occurring when shingle assemblies are stacked upon each other while being mounted on a roof 8.

The panel 12 comprises an inner layer 40 covered by an upper layer 42 and a lower layer 44. The inner layer 40 comprises a resiliently flexible plastic material. The upper 42 and lower 44 layers comprise a water impermeable material and may include any conventional material used for shingle construction. The inner layer 40 provides some rigidity to the assembly 10 to prevent it from bending and lifting during high winds.

The panel 12 has a length from the front edge 14 to the rear edge 16 between 12 inches and 30 inches and a width from the first side edge 18 to the second side edge 20 greater than 18 inches. The height of the panel 12 is between 0.30 inches and 0.70 inches. The front edge 14 has a plurality of slots 46 therein extending toward the intermediate section 36. The slots 46 are equally spaced from each other and the first 18 and second 20 side edges. The slots 46 extend through the top 22 and bottom 24 sides of the panel 12 and provide a traditional shingle look when used.

In use, a plurality of the shingle assemblies 10 is utilized to shingle a roof 8 in a generally conventional way. However, unlike conventional shingles, a roofer will instead start at the top of the roof 8, attaching the first sections 30 to the roof 14 adjacent to the top roof line 9. The next row of shingle assemblies 10 will then be slid under the top (or first) row so that the intermediate section 36 of each of the shingle assemblies 10 in the second row abuts the front edge 14 of the shingle assemblies 10 in the top row. The first sections 30 of the shingle assemblies 10 in the second row are then secured to the roof 8 by conventional means. This step is repeated down the roof 8 until it is completely shingled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A roof shingle assembly comprising:

a panel having a front edge, a rear edge, a first side edge, a second side edge, a top side and a bottom side, said panel having a first bend therein extending between said first and second side edges and being spaced from said front and rear edges, said panel having a second bend therein positioned adjacent to said first bend and extending between said first and second side edges, said first and second bends defining a first section positioned between said first bend and said rear edge, a second section positioned between said second bend and said front edge and an intermediate section positioned between said first and second bends, said first and second sections extending away from said intermediate section in opposite directions with respect to each other, a distance between said top side of said second section and said top side of said first section being uniform between each of said front edge, said rear edge, said first side edge, and said second side edge such that the assembly provides a flat even surface configured to receive a second one of the assemblies; and said first and second sections lying in planes orientated parallel to each other and vertically spaced from each other, said plane of said first section being positioned below a plane of said second section; and said panel comprises an inner layer covered by an upper layer and a lower layer, said inner layer comprising a resiliently flexible plastic material, said upper and lower layers comprising a water impermeable material.

2. The assembly according to claim 1, wherein a first distance measured along said bottom side of said second section from said front edge to said intermediate section being equal to or less than a second distance measured along said top side of said first section from said intermediate section to said rear edge.

3. The assembly according to claim 1, wherein a height dimension of said intermediate section measured from said bottom side of said first section to said bottom side of said second section being equal to or less than a height of said panel measured from said bottom side to said top side.

4. The assembly according to claim 1, wherein said panel has a length from said front edge to said rear edge between 12 inches and 30 inches, said panel having a width from said first side edge to said second side edge greater than 18 inches, said height of said panel being between 0.30 inches and 0.70 inches.

5. The assembly according to claim 1, wherein said front edge has a plurality of slots therein extending toward said intermediate section, said slots being equally spaced from each other and said first and second side edges, said slots extending through said top and bottom sides of said panel.

6. A roof shingle assembly comprising:

a panel having a front edge, a rear edge, a first side edge, a second side edge, a top side and a bottom side, said panel having a first bend therein extending between said first and second side edges and being spaced from said front and rear edges, said panel having a second bend therein positioned adjacent to said first bend and extending between said first and second side edges, said first and second bends defining a first section positioned between said first bend and said rear edge, a second section positioned between said second bend and said front edge and an intermediate section positioned between said first and second bends, said first and second sections extending away from said intermediate section in opposite directions with respect to each other, a distance between said top side of said second section and said top side of said first section being uniform between each of said front edge, said rear edge, said first side edge, and said second side edge such that the assembly provides a flat even surface configured to receive a second one of the assemblies;

said first and second sections lying in planes orientated parallel to each other and vertically spaced from each other, said plane of said first section being positioned below a plane of said second section;

a first distance measured along said bottom side of said second section from said front edge to said intermediate section being equal to or less than a second distance measured along said top side of said first section from said intermediate section to said rear edge;

a height dimension of said intermediate section measured from said bottom side of said first section to said bottom side of said second section being equal to or less than a height of said panel measured from said bottom side to said top side;

said panel comprising an inner layer covered by an upper layer and a lower layer, said inner layer comprising a resiliently flexible plastic material, said upper and lower layers comprising a water impermeable material;

said panel having a length from said front edge to said rear edge between 12 inches and 30 inches, said panel having a width from said first side edge to said second side edge greater than 18 inches, said height of said panel being between 0.30 inches and 0.70 inches; and said front edge having a plurality of slots therein extending toward said intermediate section, said slots being equally spaced from each other and said first and second side edges, said slots extending through said top and bottom sides of said panel.

* * * * *